United States Patent [19]

Forgac et al.

[11] 4,436,344

[45] Mar. 13, 1984

[54] IN SITU RETORTING OF OIL SHALE WITH PULSED COMBUSTION

[75] Inventors: John M. Forgac, Elmhurst, Ill.; Gerald B. Hoekstra, deceased, late of South Holland, Ill., by Edith Hoekstra, executrix

[73] Assignee: Standard Oil Company (Indiana), Chicago, Ill.

[21] Appl. No.: 265,687

[22] Filed: May 20, 1981

[51] Int. Cl.[3] ..... E21B 43/243; E21C 41/10

[52] U.S. Cl. ..... 299/2; 166/259; 166/261

[58] Field of Search ..... 299/2; 166/259, 261

[56] References Cited

U.S. PATENT DOCUMENTS 3,980,339 9/1976 Heald et al. ..... 299/2

3,994,343 11/1976 Cha et al. ..... 166/259

4,059,308 11/1977 Pearson et al. ..... 166/259 X 4,087,130 5/1978 Garrett ..... 166/261 X 4,263,970 4/1981 Cha ..... 299/2 X

*Primary Examiner*—Ernest R. Purser

*Attorney, Agent, or Firm*—Thomas W. Tolpin; William T. McClain; William H. Magidson

[57] ABSTRACT

Product yield and quality is increased during in situ retorting of oil shale by pulsed combustion in which the flow of feed gas to the flame front is intermittently stopped while continuously retorting the oil shale. A purge gas can be injected into the retort between pulses of feed gas to enhance transfer of sensible heat from the combustion zone to the retorting zone and enlarge the separation between the combustion zone and the advancing front of the retorting zone.

24 Claims, 1 Drawing Figure

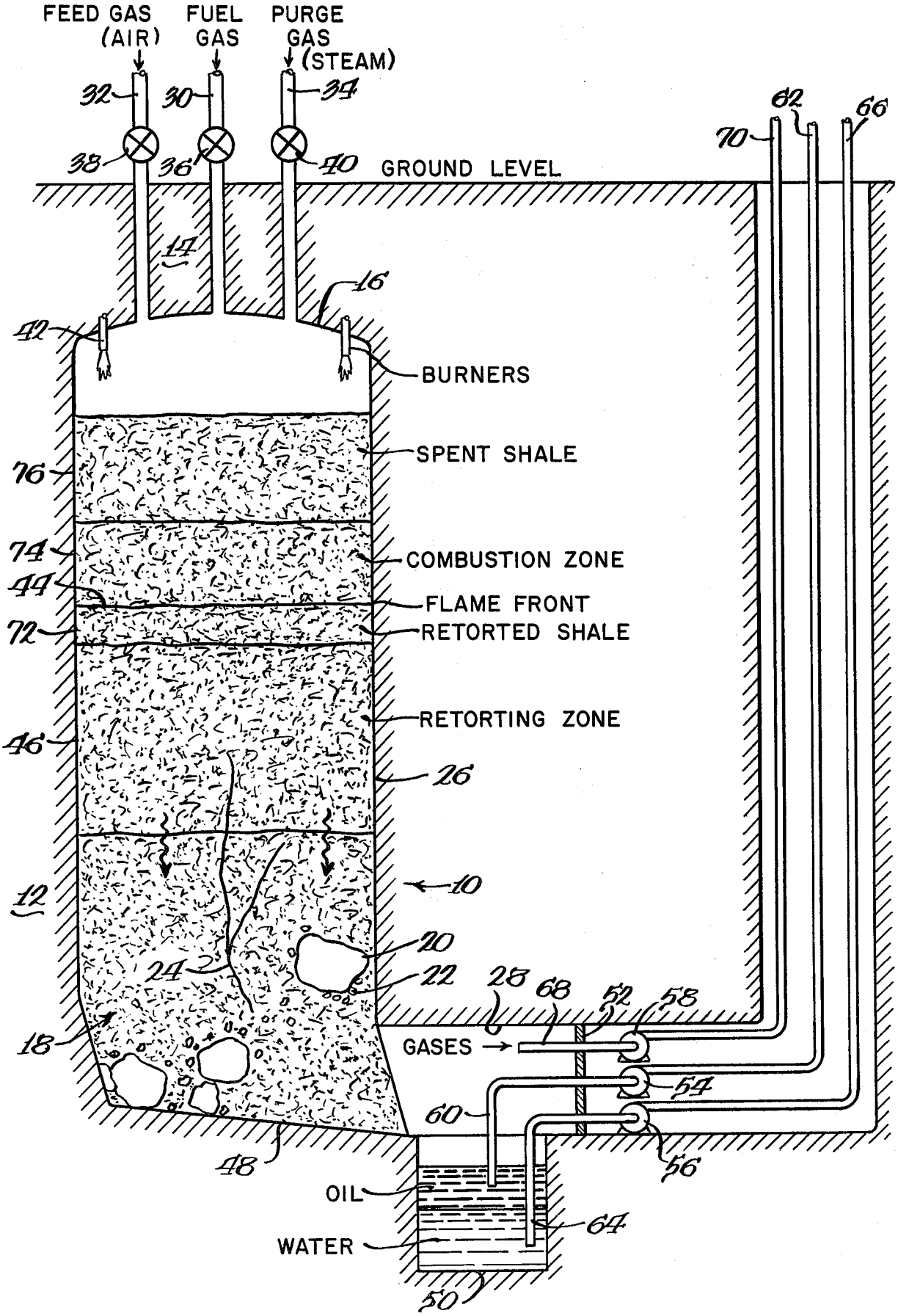
FEED GAS (AIR)
FUEL GAS
PURGE GAS (STEAM)
32
30
34
38
36
40
GROUND LEVEL
62
66
70
14
16
42
BURNERS
SPENT SHALE
76
74
COMBUSTION ZONE
44
FLAME FRONT
72
RETORTED SHALE
RETORTING ZONE
46
26
10
12
20
24
22
28
68
52
58
18
GASES
54
60
56
48
OIL
64
WATER
50

IN SITU RETORTING OF OIL SHALE WITH PULSED COMBUSTION

BACKGROUND OF THE INVENTION

This invention relates to a process for underground retorting of oil shale.

Researchers have now renewed their efforts to find alternative sources of energy and hydrocarbons in view of recent rapid increases in the price of crude oil and natural gas. Much research has been focused on recovering hydrocarbons from solid hydrocarbon-containing material such as oil shale, coal and tar sand by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah, and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

In order to obtain high thermal efficiency in retorting, carbonate decomposition should be minimized. Carbonate decomposition consumes heat, lowers thermal efficiency and decreases the heating value of off gases. Colorado Mahogany zone oil shale contains several carbonate minerals which decompose at or near the usual temperature attained when retorting oil shale. Typically, a 28 gallon per ton oil shale will contain about 23% dolomite (a calcium/magnesium carbonate) and about 16% calcite (calcium carbonate), or about 780 pounds of mixed carbonate minerals per ton. Dolomite requires about 500 BTU per pound and calcite about 700 BTU per pound for decomposition, a requirement that would consume about 8% of the combustible matter of the shale if these minerals were allowed to decompose during retorting. Saline sodium carbonate minerals also occur in the Green River formation in certain areas and at certain stratigraphic zones.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in aboveground vessels or in situ retorts underground. In situ retorts require less mining and handling than surface retorts.

In in situ retorts, a flame front is continuously passed downward through a bed of rubblized oil shale to liberate shale oil, off gases and residual water. There are two types of in situ retorts: true in situ retorts and modified in situ retorts. In true in situ retorts, the oil shale is explosively rubblized and then retorted. In modified in situ retorts, some of the oil shale is removed before explosive rubblization to create a cavity or void space in the retorting area. The cavity provides extra space for rubblized oil shale. The oil shale which has been removed is conveyed to the surface and retorted above ground.

While efforts are made to explosively rubblize the oil shale into uniform pieces, in reality the rubblized mass of oil shale contains voluminous different size fragments of oil shale ranging in size from boulders to minute fines. Smaller fragments of oil shale do not pack tightly and uniformly against the surface of large boulders. Furthermore, these different sized fragments create vertical, horizontal and irregular channels extending sporadically throughout the bed and along the wall of the retort. As a result during retorting, hot gases often flow down these channels and bypass large portions of the bed, leaving significant portions of the rubblized shale unretorted.

Different sized oil shale fragments, channeling and irregular packing and imperfect distribution of oil shale fragments cause many other deleterious effects including tilted (nonhorizontal), irregular, high temperature flame fronts in close proximity to the retorting zone and fingering, that is, flame front projections of high temperature which extend downward into the raw oil shale and advance far ahead of other portions of the flame front. High temperature flame fronts and fingering can cause carbonate decomposition, coking and thermal cracking of the liberated shale oil. Irregular, tilted flame fronts can lead to flame front breakthrough, incomplete retorting and burning of the product shale oil. Flame fronts in close proximity to the advancing front of the retorting zone can also cause combustion of the product shale oil. If a narrow portion of the flame front advances completely through the retorting zone, it can ignite the effluent oil and off gases and may cause explosions.

Oil shale boulder typically contains a large amount of oil which diffuses out very slowly over a long period of time. As the flame front of the combustion zone approaches the oil shale boulder, heated air often flows along the channel surrounding the boulder. Heated air in combination with the effluent oil from the boulder often ignites the oil. Extremely high temperatures will result and persist until the oil has stopped diffusing out of the boulder. Loss of oil is the result.

In the case of severe channeling, horizontal pathways may permit oxygen to flow underneath the raw unretorted shale. If this happens, all of the oil flowing downward in that zone may burn.

It has been estimated that losses from burning in in situ retorting are as high as 40% of the product shale oil.

Typifying the many methods of in situ retorting are those found in U.S. Pat. Nos. 1,913,395; 1,191,636; 2,481,051; 3,001,776; 3,586,377; 3,434,757; 3,661,423; 3,951,456; 4,007,963; 4,017,119; 4,126,180; 4,133,380; 4,149,752; 4,194,788 and 4,243,100. These prior art processes have met with varying degrees of success.

One particularly advantageous process of in situ retorting oil shale is described in U.S. patent application, Ser. No. 198,850, filed Oct. 20, 1980, by Gerald B. Hoekstra and David R. Christian, one half interest of which is owned by the assignee of the present invention. U.S. patent application, Ser. No. 198,850 is hereby expressly incorporated herein by reference.

It is, therefore, desirable to provide an improved process for in situ retorting of oil shale.

SUMMARY OF THE INVENTION

An improved in situ process is provided to retort oil shale which increases product yield and quality. In the novel process, flow of feed gas to the flame front is intermittently stopped to alternately extinguish and ignite the flame front while continuously retorting the oil shale. This alternate extinguishment and ignition of the flame front is referred to as "pulsed combustion."

Pulsed combination promotes uniformity of the flame front and minimizes fingering and projections of excessively high temperature zones in the rubblized bed of shale. When the combustions-sustaining feed gas is shut off, combustion stops and burning of product oil is quenched and the area in which the flame front was present remains stationary during shut off to distribute heat downward in the bed. Upon reignition, a generally horizontal flame front is established which advances in the general direction of flow of the feed gas. Intermittent injection of feed gas lowers the temperature of the flame front, minimizes carbonate decomposition, coking and thermal cracking of liberated hydrocarbons. The pulse rate and duration of the feed gas control the profile of the flame front.

Between pulses, heat is dissipated throughout the bed where retorting was incomplete or missed and these regions retorted to increase product recovery. Thermal irregularities in the bed equilibriate between pulses to lower the maximum temperature in the retort.

During periods of noncombustion, sensible heat from the retorted and combusted shale advance downward through the raw colder shale to heat and continue retorting the bed. Continuous retorting between pulses, advances the leading edge (front) of the retorting zone and thickens the layer of retorted shale containing unburned, residual carbon to enlarge the separation between the combustion and retorting zones when the flame front is reignited in response to injection of the next pulse of feed gas. Greater separation between the combustion and retorting zones decreases flame front breakthrough, oil fires and gas explosions.

During feed gas shutoff, the liberated shale oil has more time to flow downward and liquefy on the colder raw shale. Drainage and evacuation of oil during noncombustion moves the effluent oil farther away from the combustion zone upon reignition to provide an additional margin of safety which diminishes the chances of oil fires.

Additional benefits of pulsed combustion include the ability to more precisely detect the location and configuration of the flame front and retorting zone by monitoring the change of off gas composition.

In one preferred form, a purge gas and a feed gas are alternately injected into the combustion zone while retorting of the raw oil shale continues. The purge gas extinguishes the flame front and accelerates transfer of sensible heat to the raw shale. The purge gas helps drive the retorting zone downward and increases the rate of advancement of the retorting zone. The use of purge gas also increases the amount of separation between the retorting and combustion zones.

The purge gas can consist of steam, nitrogen, hydrogen, carbon dioxide, raw off gases or processed off gases which have been stripped of hydrocarbons.

The term "spent" shale as used herein means retorted shale from which all of the residual carbon has been removed by combustion.

The terms "normally liquid," "normally gaseous," "condensible," "condensed," and "noncondensible" as used throughout this application are relative to the condition of the subject material at a temperature of 77° F. (25° C.) at atmospheric pressure.

As used throughout this application, the term "retorted" shale refers to oil shale which has been retorted to liberate hydrocarbons leaving an organic material containing residual carbon.

A more detailed explanation of the invention is provided in the following description and appended claims taken in conjunction with the accompanying drawing.

BRIEF DESCRIPTION OF THE DRAWING

The FIGURE is a schematic cross-sectional view of an in situ retort for carrying out a process in accordance with principles of the present invention.

DETAILED DESCRIPTION OF THE PREFERRED EMBODIMENT

Referring now to the drawing, an underground, modified in situ, oil shale retort 10 located in a subterranean formation 12 of oil shale is covered with an overburden 14. Retort 10 is elongated, upright, and generally box-shaped, with a top or dome-shaped roof 16.

Retort 10 is filled with an irregularly packed, fluid permeable, rubblized mass or bed 18 of different sized oil shale fragments including large oil shale boulders 20 and minute oil shale particles or fines 22. Irregular, horizontal and vertical channels 24 extend throughout the bed and along the walls 26 of retort 10.

The rubblized mass is formed by first mining an access tunnel or drift 28 extending horizontally into the bottom of retort 10 and removing from 2% to 40% and preferably from 15% to 25% by volume of the oil shale from a central region of the retort to form a cavity or void space. The removed oil shale is conveyed to the surface and retorted in an above ground retort. The mass of oil shale surrounding the cavity is then fragmented and expanded by detonation of explosives to form the rubblized mass 18.

Conduits or pipes 30, 32 and 34 extend from the above ground level through overburden 14 into the top 16 of retort 10. Pipes 30, 32 and 34 include ignition fuel line 30, feed gas line 32 and purge gas line 34. The extent and rate of gas flow through lines 30, 32 and 34 are regulated and controlled by valves 36, 38 and 40, respectively. Burners 42 are located in proximity to the top of the bed 18.

In order to commence retorting of the rubblized mass 18 of oil shale, a liquid or gaseous fuel, preferably a combustible ignition gas or fuel gas, such as recycled off gases or natural gas, is fed into retort 10 through fuel line 30 and an oxygen-containing, flame front-supporting, feed gas, such as air, is fed into retort 10 through feed gas line 32. Burners 42 are then ignited to establish a flame front 44 horizontally across the bed 18. If economically feasible or otherwise desirable, the rubblized mass 18 of oil shale can be preheated to a temperature slightly below the retorting temperature with the a preheating before introduction of feed gas and ignition of the flame front. After ignition, fuel valve 36 is closed to shut off inflow of fuel gas. Once the flame front is established, residual carbon contained in the oil shale usually provides an adequate source of fuel to maintain the flame front as long as oxygen-containing feed gas is supplied to the flame front.

The oxygen-containing feed gas sustains and drives the flame front 44 downwardly through the bed 18 of oil shale. The feed gas can be air, or air enriched with oxygen, or air diluted with steam or recycled off gas, as long as the feed gas has from 5% to less than 90% and preferably from 10% to 30% and most preferably a maximum of 20% by volume molecular oxygen. The oxygen content of the feed gas can be varied throughout the process.

Flame front 44 emits combustion off gases and generates heat which move downwardly ahead of flame front 44 and heats the raw, unretorted oil shale in retorting zone 46 to a retorting temperature from 900° F. to 1200° F. to retort and pyrolyze the oil shale in retorting zone 46. During retorting, hydrocarbons are liberated from the raw oil shale as a gas, vapor, mist or liquid droplets and most likely a mixture thereof. The liberated hydrocarbons include light gases and normally liquid shale oil which flow downward, condense and liquefy upon the cooler, unretorted raw shale below the retorting zone.

Off gases emitted during retorting include various amounts of hydrogen, carbon monoxide, carbon dioxide, ammonia, hydrogen sulfide, carbonyl sulfide, oxides of sulfur and nitrogen and low molecular weight hydrocarbons. The composition of the off gas is dependent on the composition of the feed gas.

The effluent product stream of liquid oil, water, and off gases mixed with light gases and steam emitted during retorting, flow downward to the sloped bottom 48 of retort 10 and then into a collection basin and separator 50, also referred to as a "sump" in the bottom of access tunnel 28. Concrete wall 52 prevents leakage of off gas into the amine. The liquid shale oil, water and gases are separated in collection basin 50 by gravity and pumped to the surface by pumps 54, 56, and 58, respectively, through inlet and return lines 60, 62, 64, 66, 68 and 70, respectively.

Raw off gases can be recycled as part of the fuel gas or feed gas, either directly or after light gases and oil vapors contained therein have been stripped away in a quench tower or stripping vessel.

During the process, retorting zone 46 moves downward leaving a layer or band 72 of retorted shale with residual carbon. Retorted shale layer 72 above retorting zone 46 defines a retorted zone which is located between retorting zone 46 and the flame front 44 of combustion zone 74. Residual carbon in the retorted shale is combusted in combustion zone 74 leaving spent, combusted shale in a spent shale zone 76.

In order to enhance a more uniform flame front 44 across retort 10, feed gas (air) in line 32 is fed into retort 10 in pulses by intermittently stopping the influx of feed gas with control valve 38 to alternately quench and reignite flame front 44 for selected intervals of time. Preferably, a purge gas is injected into combustion zone 74 through purge gas line 34 between pulses of feed gas. The purge gas extinguishes flame front 44 and accelerates transfer of sensible heat from combustion zone 74 to retorting zone 46.

During purging, i.e., between pulses of feed gas, retorting of oil shale continues. The purge gas enhances the rate of downward advancement of retorting zone 46 to widen the gap and separation between the leading edge or front of retorting zone 46 and the combustion zone 74. Purging also thickens the retorted shale layer 72 and enlarged the separation between retorting zone 46 and combustion zone 74. The enlarged separation minimizes losses from oil burning upon reignition which occurs when the next pulse of feed gas is injected. The combustion zone 72 can be cooled to a temperature as low as 650° F. by the purge gas and still have successful ignition with the next pulse of feed gas.

The injection pressure of the feed gas, purge gas and fuel gas is from one atmosphere to 5 atmospheres, and most preferably 2 atmospheres. The flow rate of the feed gas, purge gas and fuel gas are each a maximum of 10 SCFM/ft$^2$, preferably from 0.01 SCFM/ft$^2$ to 6 SCFM/ft$^2$, and most preferably from 1.5 SCFM/ft$^2$ to 3 SCFM/ft$^2$.

The duration of each pulse of feed gas and purge gas is from 15 minutes to 1 month, preferably from 1 hour to 24 hours and most preferably from 4 hours to 12 hours. The time ratio of purge gas to feed gas is from 1:10 to 10:1 and preferably from 1:5 to 1:1.

While steam is the preferred purge gas, the purge gas can also consist of nitrogen, hydrogen, carbon dioxide, raw off gases or recycled off gases that have been stripped of light gases and shale oil vapors, or mixtures thereof.

While vertical retorts are preferred, horizontal and irregular retorts can be used. Futhermore, while it is preferred to commence pulsed combustion at the top of the bed of shale in the retort, in some circumstances it may be desirable to commence pulsing at other sections of the retort at or after commencing retorting.

Among the many advantages of the above process are:

1. Improved product yield and recovery.
2. Uniformity of flame front.
3. Greater retorting.
4. Fewer oil fires.
5. Less loss of product oil.
6. Decreased carbonate decomposition and thermal cracking of the effluent shale oil.

Although an embodiment of this invention has been shown and described, it is to be understood that various modifications and substitutions, as well as rearrangements and combinations of process steps, can be made by those skilled in the art without departing from the novel spirit and scope of this invention.

What is claimed is:

1. A process for retorting oil shale, comprising the steps of:

heating a portion of a rubblized mass of oil shale to a retorting temperature to liberate shale oil and off gases containing hydrocarbons from said oil shale leaving retorted shale containing residual carbon;

combusting said residual carbon in said oil shale in a combustion zone behind said retorting zone in said underground retort with a flame front fed by a feed gas, said flame front advancing generally in the direction of flow of said feed gas;

quenching said flame front by blanketing said flame front with a purge gas consisting of stripped recycled off gases and subsequently reigniting said flame front while continuing to liberate shale oil and off gases containing hydrocarbons in said retorting zone;

withdrawing said liberated shale oil and off gases containing hydrocarbons from said underground retort;

stripping said hydrocarbons from said off gases; and recycling said stripped of gases to said retort for use as said purge gas.

2. A process for retorting oil shale in accordance with claim 1 wherein said retorting zone has a leading edge and said leading edge is advanced when said flame front is quenched.

3. A process for retorting oil shale in accordance with claim 2 wherein said leading edge of said retorting zone is spaced a distance in front of said flame front and said quenching followed by reignition enlarges said distance.

4. A process for retorting oil shale, comprising the steps of:

heating a portion of a rubblized mass of oil shale in a retorting zone of an underground retort to a temperature from 900° F. to 1200° F. to liberate hydrocarbons from said oil shale leaving retorted shale containing carbon residue;

combusting said carbon residue in said retorted oil shale in a combustion zone above said retorting zone in said underground retort with a flame front;

pulsing a combustion-supporting feed gas containing from 5% to less than 90% by volume molecular oxygen into said combustion zone to repetitively ignite and extinguish said flame front for preselected periods of time;

injecting a flame front-extinguishing purge gas consisting essentially of steam into said combustion zone between said pulses; and withdrawing said liberated hydrocarbons from said retort.

5. A process for retorting oil shale in accordance with claim 4 wherein said feed gas contains from 10% to 30% by volume molecular oxygen.

6. A process for retorting oil shale in accordance with claim 4 wherein said feed gas consists of air.

7. A process for retorting oil shale in accordance with claim 4 wherein said feed gas consists of air and steam.

8. A process for retorting oil shale in accordance with claim 4 wherein the oxygen content of said feed gas is varied.

9. A process for retorting oil shale, comprising the steps of:

(a) forming a generally upright modified in situ underground oil shale retort in a subterranean formation of raw oil shale by removing from 2% to 40% by volume of said oil shale from said formation leaving a cavity, transporting said removed shale to a location above ground for surface retorting, and explosively rubblizing a mass of said oil shale substantially surrounding said cavity to form said underground retort;

(b) igniting a flame front generally across said retort;

(c) pyrolyzing a portion of said rubblized raw oil shale in a retorting zone of said underground retort to liberate shale oil and off gases containing hydrocarbons from said raw oil shale leaving retorted shale containing residual carbon;

(d) advancing said retorting zone generally downwardly in said underground retort;

(e) combusting residual carbon on said retorted shale in a combustion zone above said retorting zone in said underground retort with a flame front;

(f) alternately injecting a flame front-supporting feed gas and a flame front-extinguishing purge gas consisting essentially of hydrogen, nitrogen, steam, and carbon dioxide, into said combustion zone while continuing step (d), said flame front-supporting feed gas supporting, igniting and propelling said flame front generally downwardly in said underground retort, said flame front-extinguishing purge gas extinguishing said flame front and accelerating transfer of sensible heat from said combustion zone to said retorting zone; and (g) withdrawing said liberated shale oil and off gases containing hydrocarbons from said underground retort.

10. A process for retorting oil shale in accordance with claim 9 wherein a layer of said retorted shale containing residual carbon separates said retorting zone and said combustion zone and the thickness of said layer increases during step (f).

11. A process for retorting oil shale in accordance with claim 9 wherein said purge gas consists of steam.

12. A process for retorting oil shale in accordance with claim 9 wherein said purge gas consists of nitrogen.

13. A process for retorting oil shale in accordance with claim 9 wherein said purge gas consists of hydrogen.

14. A process for retorting oil shale in accordance with claim 9 wherein said purge gas consists of carbon dioxide.

15. A process for retorting oil shale in accordance with claim 9 wherein 15% to 25% of said raw oil shale is removed from said subterranean formation.

16. A process for retorting oil shale in accordance with claim 9 including cooling said combustion zone with said purge gas to a temperature greater than 650° F. and less than 800° F. before reignition.

17. A process for retorting oil shale in accordance with claim 9 wherein the flow rate of said purge gas and said feed gas is a maximum of 10 SCFM/ft$^2$ and the injection pressure of said purge gas and said feed gas is a maximum of 2 atmospheres.

18. A process for retorting oil shale in accordance with claim 9 wherein the flow rate of said purge gas and said feed gas is from 0.01 SCFM/ft$^2$ to 6 SCFM/ft$^2$, and the injection pressure of said purge gas and said feed gas is from 1 atmosphere to 5 atmospheres.

19. A process for retorting oil shale in accordance with claim 9 wherein the flow rate of said purge gas and said feed gas is from 1.5 SCFM/ft$^2$ to 3 SCFM/ft$^2$.

20. A process for retorting oil shale in accordance with claim 9 wherein the duration of each of said injections is from 15 minutes to 1 month.

21. A process for retorting oil shale in accordance with claim 9 wherein the duration of each of said injections is from 1 hour to 24 hours.

22. A process for retorting oil shale in accordance with claim 9 wherein the duration of each of said injections is from 4 hours to 12 hours.

23. A process for retorting oil shale in accordance with claim 9 wherein the time ratio of purge gas to feed gas is from 1:10 to 10:1.

24. A process for retorting oil shale in accordance with claim 23 wherein said time ratio is from 1:5 to 1:1.

* * * * *

UNITED STATES PATENT OFFICE

CERTIFICATE OF CORRECTION

Patent No. 4,436,344 Dated March 13, 1984

Inventor(s) John M. Forgac and Gerald B. Hoekstra

It is certified that error appears in the above-identified patent and that said Letters Patent are hereby corrected as shown below:

| Patent Column | Line | |
|---|---|---|
| 3 | 25 | reads "combination" and should read --combustion-- |
| 3 | 28 | reads "combustions" and should read --combustion-- |
| 5 | 7 | delete "with the a" |
| 5 | 8 | delete "preheating" |
| 5 | 47 | reads "amine" and should read --mine-- |
| 6 | 12 | reads "enlarged" and should read --enlarges-- |
| 7 | 11 | reads "of" and should read --off-- |

Signed and Sealed this

*Ninth* Day of *July 1985*

[SEAL]

*Attest:*

DONALD J. QUIGG

*Attesting Officer* *Acting Commissioner of Patents and Trademarks*